United States Patent [19]

Foster

[11] Patent Number: 4,941,807

[45] Date of Patent: Jul. 17, 1990

[54] HYDRAULIC POWER GENERATING PACK

[75] Inventor: Malcolm C. Foster, Sandal, England

[73] Assignee: Gullick Dobson Limited, Horbury, England

[21] Appl. No.: 307,787

[22] Filed: Feb. 7, 1989

[30] Foreign Application Priority Data

Feb. 20, 1988 [GB] United Kingdom ..... 8803974

[51] Int. Cl.[5] ..... F04B 23/08

[52] U.S. Cl. ..... 417/199.1; 417/287; 417/426

[58] Field of Search ..... 417/199.1, 271, 287, 417/415, 426, 429; 91/170 M P

[56] References Cited

U.S. PATENT DOCUMENTS

| | | | |
|---|---|---|---|
| 1,818,768 | 8/1931 | Swartwout | 417/287 |
| 2,367,452 | 1/1945 | Wheatley, Sr. | 417/426 X |
| 3,385,217 | 5/1968 | Bles | 417/287 |
| 3,485,176 | 12/1969 | Telford et al. | 417/287 X |
| 3,796,517 | 3/1974 | Praddaude | 417/426 X |
| 3,985,472 | 10/1976 | Virtue et al. | 417/287 X |
| 4,381,904 | 5/1983 | Kyte et al. | 417/287 |

*Primary Examiner*—John Rivell

*Attorney, Agent, or Firm*—R. A. Giangiorgi

[57] ABSTRACT

An hydraulic power generating pack 1 comprises a primary pump 23 of the multi-cylinder, reciprocating ram type with a reciprocable piston 27 located in each cylinder 28 and displaceable by a crank shaft 20 rotatable by a prime mover 2 to provide a primary hydraulic fluid output 32 at a predetermined constant pressure and constant volume, and a power take off 14 to drive a secondary pump 36 of the pressure compensated variable delivery type, the output 40 of which drives a pressure intensifier 42 serving to intensify, to the required secondary pressure and volume, hydraulic fluid supplied to the intensifier 42 at a first pressure and volume.

8 Claims, 1 Drawing Sheet

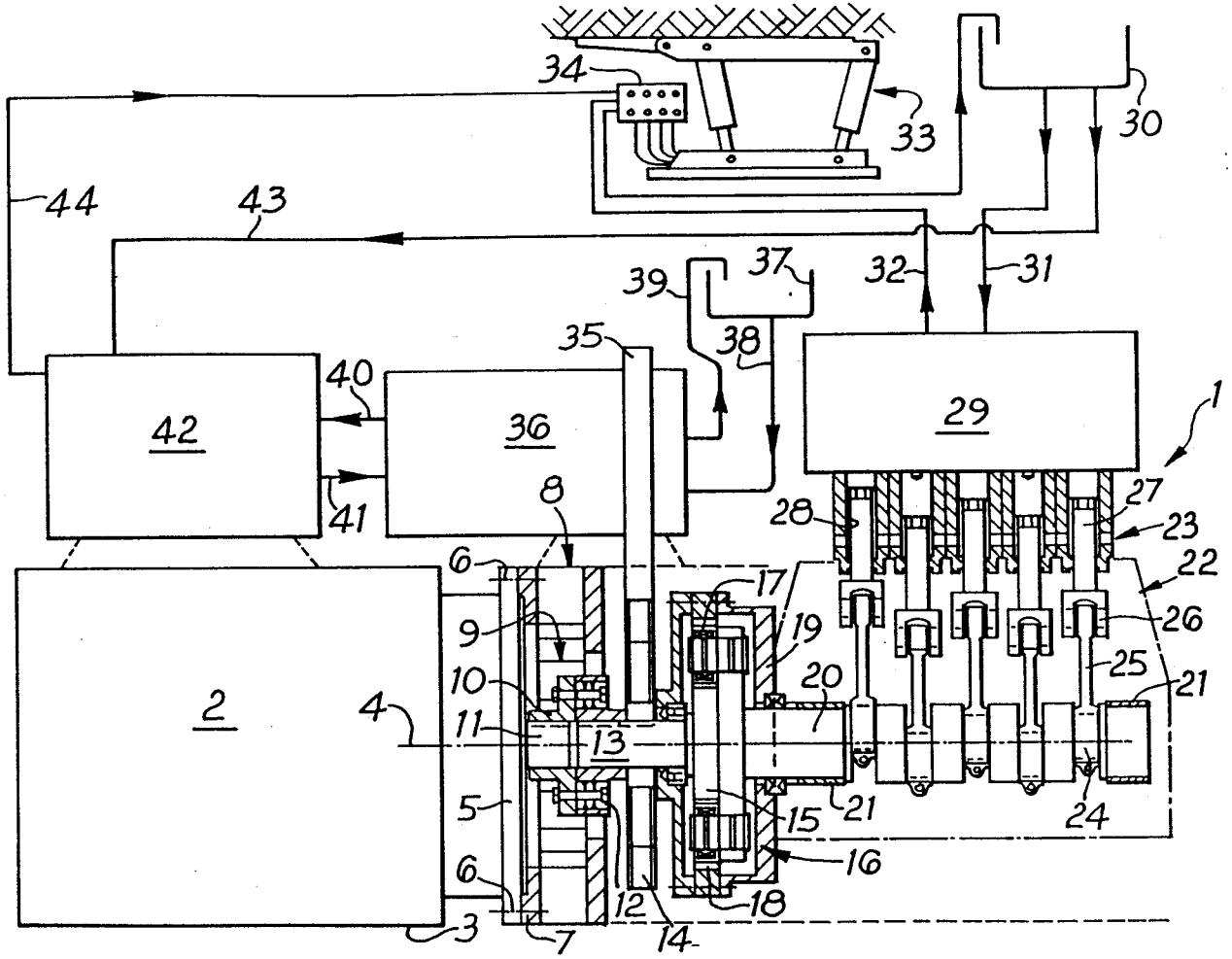
1
2
3
4
5
6
7
8
9
10
11
12
13
14
15
16
17
18
19
20
21
22
23
24
25
26
27
28
29
30
31
32
33
34
35
36
37
38
39
40
41
42
43
44

HYDRAULIC POWER GENERATING PACK

This invention relates to an hydraulic power generating pack comprising a pump of the multi-cylinder, reciprocating ram type, with the pistons of the cylinders displaced by a crank shaft driven from a prime mover such as an electric motor.

Such pumps are of a constant delivery volume and constant pressure kind, but not infrequently there is a requirement for delivery of fluid at a secondary, different pressure and volume from the primary pressure and volume. Such a requirement occurs for instance in the setting of hydraulically powered, self-advancing mine roof supports, where the pump output i.e. primary pressure and volume, is employed for setting the roof support to the roof, and for other, ancillary hydraulic equipment of the roof support, with the secondary pressure and volume requirement being to provide a so-called positive set pressure, this being higher than the primary pressure but at a much lower volume.

Conventionally, this secondary pressure and volume has been provided simply by attaching a secondary pump, also of the multi-cylinder, reciprocating ram type, to the crank shaft of the primary pump. From the engineering view point this arrangement is unsatisfactory in that torsional vibrations are introduced in the composite primary/secondary pump, while furthermore it is necessary, because of the positive displacement of the secondary pump, to introduce an unloading valve into the associated hydraulic circuit, but due to the high pressure/low flow from the secondary pump, conventional unloading valves are unreliable in operation and furthermore have a limited useful working range.

In an alternative prior art arrangement used in connection with hydraulic mine roof supports, the secondary pressure and volume are generated by an intensifier powered by a fixed displacement pump also with an unloading valve upstream of the intensifier. However, mine roof supports conventionally operate on 95/5 water/soluble oil emulsion which is not the optimum fluid for intensifiers resulting in premature failure or short service life of the intensifier, as both the large and small surface areas of its piston are in contact with this emulsion.

According to the present invention, there is provided an hydraulic power generating pack comprising a primary pump of the multi-cylinder, reciprocating ram type with a reciprocable piston located in each cylinder and displaceable by a crank shaft rotatable by a prime mover to provide a primary hydraulic fluid output at a predetermined constant pressure and constant volume, and a power take off to drive a secondary pump of the pressure compensated variable delivery type, the output of which drives a pressure intensifier serving to intensify, to the required secondary pressure and volume, hydraulic fluid supplied to the intensifier at a first pressure and volume.

Thus, the pack in accordance with the invention completely avoids the torsional vibrations inherently present with of the "add-on" secondary pumps with crank shafts of the prior art, in that a true rotary drive is involved that is not, in contrast with the prior art proposals, out of phase with the crank shaft of the primary pump. Furthermore, because the secondary pump is of the kind specified, the supply from the intensifier is on demand. Consequently, the requirement for unloading valves—to dump excess secondary fluid—is totally avoided. A further advantage with the pack in accordance with the invention is the ability to drive the secondary, pressure compensated variable delivery pump, with mineral oil, so that the output of this secondary pump, to the large area side of a conventional intensifier, is of mineral oil, which does not damage the intensifier and consequently increases the service life of the intensifier, compared with the conventional 95/5 water/soluble oil emulsion used to power mine roof supports and required as the output from the small area side of the intensifier. Hence, both the primary pump and the intensifier may conveniently be supplied with 95/5 emulsion from a common reservoir.

If the pack in accordance with the invention is used, for example in the setting of self-advancing mine roof supports, the intensifier stalls out at the prescribed pressure, e.g. the positive set pressure of the mine roof support, and the back pressure along the hydraulic line to the secondary, pressure compensated variable delivery pump results in the secondary pump merely being turned over, with no output, until triggered by demand via the intensifier.

Preferably, the prime mover is an electric motor e.g. of 200–300 H.P., and it is also preferred for the power take-off to the secondary, pressure compensated delivery pump to be from a gear wheel of a transmission, including a transmission shaft, between the electric motor and the crank shaft. It is also preferred for the transmission between the prime mover and the crank shaft to incorporate a flexible coupling and speed reduction gearing, preferably in the form of an epicyclic gearbox. A clutch may also be incorporated in the transmission.

The invention will now be described in greater detail by way of example, with reference to the accompanying drawing which is a part sectional and diagrammatic side elevation of an hydraulic power generating pack in accordance with the invention, and associated circuit, for setting hydraulically powered mine roof supports.

In the drawings an hydraulic power generating pack 1 comprises a prime mover in the form of a 200–300 HP electric motor 2 having a casing 3, an axis of rotation 4 and a mounting flange 5. To the latter is secured by bolts on axes 6 a mounting flange 7 of a transmission 8 comprising a flexible coupling 9, one half 10 of which is keyed to an output shaft 11 of the motor 2 and the other half 12 of which is keyed to a transmission shaft 13 coincident with the motor axis 4. Also keyed to the transmission shaft 13 is a gear wheel 14 constituting a power take off. The transmission shaft also carries a sun wheel 15 of an epicyclic gearbox 16 in mesh with planet wheels 17, in turn in mesh with an annulus 18, while a carrier 19 is drivably attached to a crank shaft 20 rotatably mounted in two spaced apart plain bearings 21 of a block 22 of a constant pressure, constant volume primary pump 23, the crank shaft 20 having five crank pins 24 each carrying a connecting rod 25 each attached to a gudgeon pin 26 to a reciprocable ram type piston 27 located in a cylinder 28 of a head 29, the valve gear of which is not illustrated. However, if the primary pump 23 is to operate on 95/5 water/soluble oil emulsion, the latter is housed in a reservoir 30, with a supply line 31 incorporating conventional items such as filters (not shown) to the primary pump 23, with an output line 32 to a load, such as a mine roof support 33 via a control valve block 34.

The power take-off gearwheel 14 is in mesh with a driven gearwheel 35 of a secondary pump 36 of the pressure compensated, variable delivery type, which pumps mineral oil contained in a reservoir 37 from which extend supply and return lines 38, 39 to the secondary pump 36. From the secondary pump 36 extend delivery and return lines 40, 41 to the large area side of a conventional intensifier 42, with a supply line 43 from the emulsion reservoir 30 to the large area side of the intensifier 42, and a delivery line 44 from the small area side of the intensifier 42 to the hydraulic roof support 33. Valving and other details of the intensifier 42 are not illustrated, as this is a well known, proprietary component.

What I claim is:

1. An hydraulic power generating pack comprising a primary pump of the multi-cylinder, reciprocating ram type, a reciprocable piston located in each of said cylinders and a crank shaft rotatable by a prime mover and serving to displace each said piston to provide a primary hydraulic fluid output at a predetermined constant pressure and constant volume, a power take-off, a secondary pump of the pressure compensated variable delivery type, driven by said power take-off, a pressure intensifier output from said secondary pump driving an intensifier which intensifies to a required secondary pressure and volume, hydraulic fluid supplied to said intensifier at a first pressure and volume.

2. A pack as claimed in claim 1, wherein said secondary pump supplies mineral oil to said intensifier.

3. A pack as claimed in claim 1, wherein a common reservoir supplies said primary pump and said intensifier.

4. A pack as claimed in claim 1, wherein an electric motor constitutes said prime mover.

5. A pack as claimed in claim 1, comprising a transmission, a transmission shaft included in said transmission, a gearwheel located between said prime mover and said crank shaft, forming part of said transmission and constituting said power take-off to said secondary pump.

6. A pack as claimed in claim 1, wherein a flexible coupling is incorporated in said transmission between said prime mover and said crank shaft.

7. A pack as claimed in claim 1, wherein speed reduction gearing is incorporated in said transmission between said prime mover and said crank shaft.

8. A pack as cl aimed in claim 7, wherein an epicyclic gearbox constitutes said gearing.

* * * * *